United States Patent [19]

Wells

[11] 4,139,080

[45] Feb. 13, 1979

[54] HUNTER'S TREE STAND

[76] Inventor: Milton C. Wells, 5583 Clinton Dr., Erie, Pa. 16509

[21] Appl. No.: 883,643

[22] Filed: Mar. 6, 1978

[51] Int. Cl.[2] ..... E06C 1/56; E06C 7/48; A47C 9/10

[52] U.S. Cl. ..... 182/115; 182/187; 182/196; 182/222

[58] Field of Search ..... 182/187, 82, 222, 223, 182/196, 188, 115

[56] References Cited

U.S. PATENT DOCUMENTS

| | | | |
|---|---|---|---|
| 305,100 | 9/1884 | Moore | 182/187 |
| 2,101,245 | 12/1937 | De Franco | 182/120 |
| 3,762,502 | 10/1973 | Lawson | 182/223 |
| 3,961,686 | 6/1976 | Starkey | 182/187 |

*Primary Examiner*—Reinaldo P. Machado
*Attorney, Agent, or Firm*—Charles L. Lovercheck

[57] ABSTRACT

A tree platform supported between two tree branches made up of a platform-like member having ends suitable to slide down between two diverging tree branches, two legs are hinged to the underside of the platform member and a turnbuckle engages the lower ends of the legs forcing them out into engagement with the tree branches thereby holding the platform in place. The turnbuckle ends are generally elliptical in shape and have outer peripheral grooves which receive the loops of two ropes that dangle from the turnbuckle and ladder steps are supported on the two ropes providing a ladder for a person to climb into place on the platform. The ladder will also provide a rope for a hunter to drag a deer.

5 Claims, 5 Drawing Figures

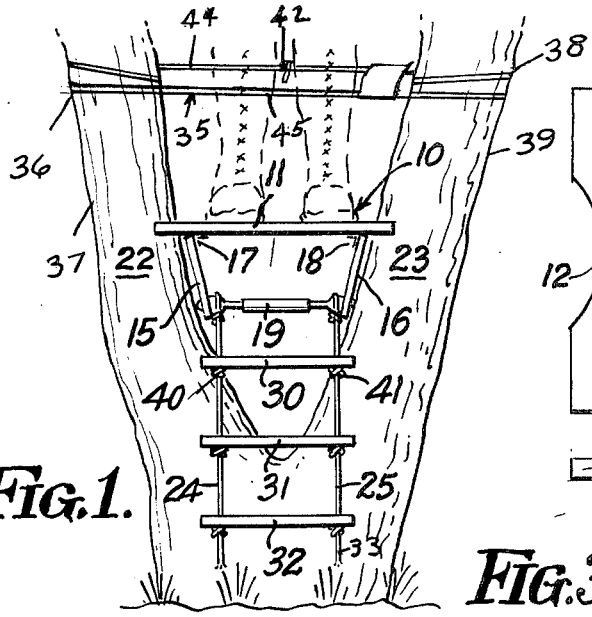
FIG. 1.
FIG. 2.
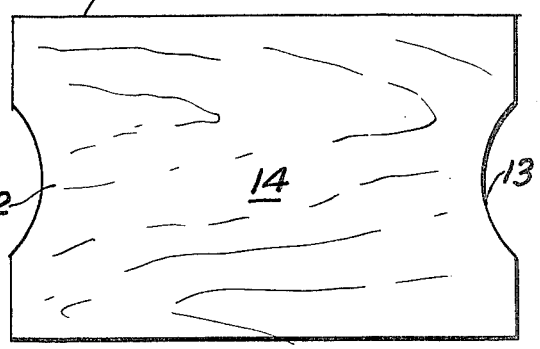
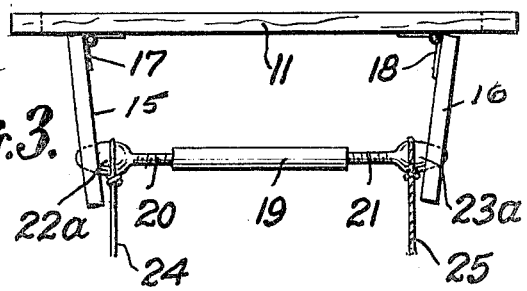
FIG. 3.
FIG. 4.
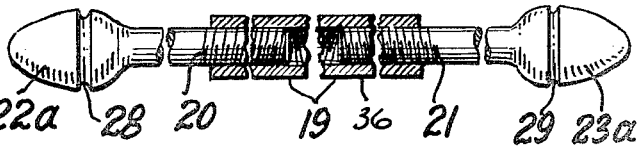
FIG. 5.
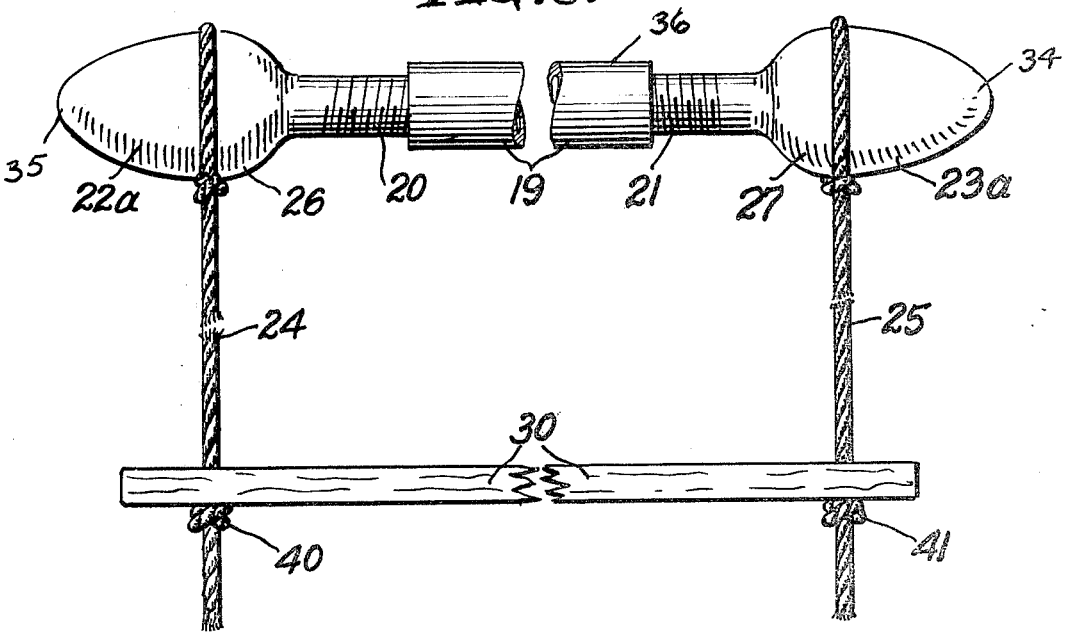

HUNTER'S TREE STAND

GENERAL DESCRIPTION OF THE INVENTION

The tree platform disclosed herein can be supported above the ground between two adjacent tree trunks or between two branches of a forked tree. The platform can be rigidly anchored in place by the turnbuckle and downwardly extending legs so that the platform will be rigid, strong and safe to stand or sit on. A hunter can climb the rope ladder which is attached to the platform and then pull the ladder up after him so that it will not frighten game and he can use the rope ladder as a harness for dragging deer or other large game once they are bagged.

REFERENCE TO PRIOR ART

Previous hunters' stands have been suitable for support to the side of a tree for hunters to sit upon and have not been strong and safe for use. Applicant has provided an improved tree stand that is simple, rigid in construction and strong for use and requires no nails or other anchoring devices that would permanently injure a tree trunk and be illegal in certain areas.

OBJECTS OF THE INVENTION

It is an object of the invention to provide an improved tree stand. Another object of the invention is to provide a tree stand that is simple in construction, economical to manufacture and simple and efficient to use. Another object of the invention is to provide a tree stand that requires no permanent anchoring device to be supported in a tree.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a partial view of the tree platform supported between two branches of a tree according to the invention.

FIG. 2 is a top view of the platform.

FIG. 3 is a side view of the platform.

FIG. 4 is an end view of the turnbuckle partly in cross section.

FIG. 5 is a side view of the turnbuckle and ladder according to the invention.

DETAILED DESCRIPTION OF THE DRAWINGS

Now with more particular reference to the drawing, the tree support is shown generally at 10 made up of a platform 11 having two notches 12 and 13 formed in the ends of the platform. The platform has a flat top surface 14 on which a hunter can stand with his feet or could sit.

Two spaced legs 15 and 16 are hinged to the platform 11 and they connect to the bottom of the platform by means of hinges 17 and 18 and the turnbuckle 19 has the elliptical shaped ends 34 and 35 each of which have peripheral grooves 28 and 29 which receive the loops 26 and 27 of the rope ladder.

The male threaded members 20 and 21 are integrally formed on the elliptical members 34 and 35 and male threaded members are threadably received inside the hollow threaded sleeve 36 of the turnbuckle 19.

The loops 26 and 27 of the ropes 24 and 25 are received in the grooves 28 and 29 and the step 30, 31 and 32 have holes in their ends that receive the ropes 24 and 25 and knots 40 and 41 are tied below the steps so that the steps will not slide downwardly. The ladder is shown with steps 19, 30 and 31 but could have more or less steps depending on the desire of the user. The rope ends 33 can be attached to a bow or firearm to pull it up after the hunter has climbed to his position on the platform. In use the hunter inserts the pointed ends 34 and 35 in the openings in the legs 15 and 16 after supporting the plank 11 between two proper tree branches. The word "branch" is used instead of trunk to designate a branch of a tree or trunk since the seat could be used between two adjacent tree trunks or between two branches of a single tree. The hunter can pull the rope ladder up after him and can use it as a sling to drag game he may have bagged.

The safety rope 35 may be wrapped at 36 around tree trunk 37 and at 38 around tree trunk 39. The two ends of the rope may be knotted or otherwise attached together at 42 and the plastic sleeve 43 may be fastened around the rope adjacent one of the tree trunks to hold the ends of the rope together. The hunter may then stand between the two parts 44 and 45 of the rope elevating the rope 35 to a position waist-high above the platform thereby providing a safety rope on each side of his body to prevent him from falling off of the platform. He may lean against the rope without fear of falling from the stand.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tree platform adapted to be supported between two tree branches comprising, a plank (11) having recesses (12, 13) in its ends to receive the branches of a tree, said plank being adapted to be received between two generally vertical branches, and outward force applying means for engaging said tree trunk for supporting said platform, said platform having, legs (15, 16), hinge means hingedly connecting said legs to said platform, and said force applying means being adapted to engage said legs forcing them outwardly in engagement with said tree branches for holding said platform in position.

2. The combination recited in claim 1 wherein said force applying means comprise, a turnbuckle and end members having a peripheral groove, and a rope ladder, said rope ladder having a plurality of steps and means to the distal end of said rope ladder for attaching an article thereto for lifting said article.

3. The platform recited in claim 2 wherein said turnbuckle and end members engage said legs, said rope ladder having two spaced rope members each having a loop at its ends, said loop extending around said end members and being received in said groove.

4. The platform recited in claim 2 whrein said turnbuckle comprises, two externally threaded end members, and an internally threaded sleeve receiving said end members and adapted to be rotated to move said end members in a direction away from each other whereby said legs on the said platform are forced into engagement with said tree.

5. In combination a tree plank-like platform and two legs swingably attached to said platform, said platform having notched ends adapted to be received between two generally vertical tree branches, a turnbuckle, a hole in each said leg spaced from said plank, said turnbuckle having points on the ends thereof received in said holes and adapted to engage said tree trunk forcing said legs outwardly into engagement with said tree branches for holding said platform rigidly in position.

* * * * *